United States Patent [19]

Knipiler et al.

[11] Patent Number: 5,061,177

[45] Date of Patent: Oct. 29, 1991

[54] METHOD AND APPARATUS FOR HEATING A FLOW OF GASEOUS FLUID BY SUCCESSIVE THERMAL EXCHANGES

[75] Inventors: Gaston Knipiler, Rumilly; Philippe Suhas, Mo Clichy; Gosselin Dominique, Soisy Sous Montmorency, all of France

[73] Assignee: Gaz de France, Paris, France

[21] Appl. No.: 497,321

[22] Filed: Mar. 22, 1990

[30] Foreign Application Priority Data

Mar. 24, 1989 [FR] France ..... 89 04214

[51] Int. Cl.[5] ..... F24H 1/00

[52] U.S. Cl. ..... 432/222; 34/86; 432/181; 432/72

[58] Field of Search ..... 432/72, 182, 181, 222; 34/86; 110/254

[56] References Cited

U.S. PATENT DOCUMENTS

| | | | |
|---|---|---|---|
| 3,867,102 | 2/1975 | Csathy | 110/254 |
| 3,917,444 | 11/1975 | Carthew | 432/72 |
| 4,063,590 | 12/1977 | McConnell | 34/86 |
| 4,152,399 | 5/1979 | Germerdonk et al. | 432/72 |
| 4,169,321 | 10/1979 | Nicholas | 34/86 |
| 4,324,052 | 4/1982 | Boster | 34/86 |
| 4,870,947 | 10/1989 | Kawamoto | 432/181 |

FOREIGN PATENT DOCUMENTS 428140 7/1967 Switzerland .

*Primary Examiner*—Henry C. Yuen

*Attorney, Agent, or Firm*—Pollock, VandeSande & Priddy

[57] ABSTRACT

The invention relates to a process and a device for indirectly heating a flow of gaseous fluid. According to the invention, the flow of fluid to be heated is first subjected to a first heat exchange with combustion products, in a heat exchanger (3), and is subsequently subjected to a second heat exchange with a heat-exchanging fluid circulating in a second heat-exchanger (5). The flow of fluid to be heated is then circulated in a third exchanger (7) where it is subjected to a heat exchange with the combustion products before the latter are used at the time of the first heat exchange. The third heat exchanger (7) can comprise radiating tubes (51) and convection surfaces for heating the flow of fluid in circulation, essentially by convection.

6 Claims, 2 Drawing Sheets

METHOD AND APPARATUS FOR HEATING A FLOW OF GASEOUS FLUID BY SUCCESSIVE THERMAL EXCHANGES

The invention relates to a process and a device for heating a flow of gaseous fluid, such as in particular air, for example for a pharmaceutical application.

BACKGROUND OF THE INVENTION

The production of gas, and in particular of hot air, at high temperature (which can be estimated a priori between 350° and 450° C.) with a high throughput (for example of the order of 10,000 to 30,000 $Nm^3/h$) is at present frequently brought about by a certain number of existing devices, in particular:

- by direct heating of a flow of air by gaseous combustion products which are produced from a gas burner, the flow of air and the combustion products coming into contact and mixing;
- by indirect heating of the air by means of electrical resistances;
- by indirect heating of the air via a heat exchange with one or more heat-exchanging fluids heated by gas or fuel oil.

It has, however, become apparent that these different existing systems have a certain number of disadvantages.

First, direct heating of a flow of air in contact with gaseous combustion products is proscribed for the manufacture of dietetic or pharmaceutical products, given the nature of the gases produced by mixing the combustion products and the air to be heated.

Electrical resistance heaters can only be economically used for approximately six months per year, given the high cost of electrical power during the coldest months of the year.

In the case of indirect heaters which function by heat exchange without direct contact between the combustion products and the fluid to be heated, although they represent the only devices (with the electric heaters) which allow indirect heating of the air to a temperature higher than approximately 300° C., they nevertheless have certain disadvantages, of which the following can be noted:

- the use of walls made of refractory material, which deteriorate very quickly as a result of operational deviations and successive restarting to which the device is subjected;
- the use likewise of special steels at the exchange stage between the combustion products leaving the burner and the air to be heated, the use of such steels nevertheless not preventing, in practice, frequent cracking of the walls of the exchangers, in view of the high value of the air/combustion products temperature gradient.

Finally, existence can be noted of major drops in pressure resulting from the required compactness of these exchanges.

SUMMARY OF THE INVENTION

In order to remedy these shortcomings of the known devices, the invention proposes a new type of heating system which makes it possible to increase the efficiency of the device, in particular by reducing the temperature deviations between the heating products and the heated products, at each heat exchange, and by proposing a well-designed system of calorie recovery, making it possible to produce a high-performance heating device which is versatile, reliable and less onerous than the existing devices.

To this end, the heating process according to the invention, which is, therefore, intended to provide for the heating of a flow of gaseous fluid, is characterized in that:

a) the flow of fluid in question is first subjected to a first heat exchange with combustion products which have a temperature which is higher than that of the said flow of fluid;

b) the flow of fluid is subsequently subjected to a second heat exchange with a heat-exchanging fluid;

c) the flow of fluid is then subjected to a third heat exchange with the said combustion products before the latter are used at the time of the first heat exchange.

According to an additional characteristic of the invention, it is to be preferred in practice, in order to bring about the third heat exchange,

- to transfer by radiation the calorific energy contained in the combustion products,
- to cause the energy thus radiated to be absorbed by convection surfaces,
- and then to heat, essentially by convection, the said flow of fluid which is advantageously to be made to circulate in contact with the said convection surfaces.

According to a further characteristic of the invention, it has even proved to be a priori preferable to carry out an additional heat exchange between the flow of fluid leaving the heat exchange carried out according to the above-mentioned stage b) and the flow of fluid undergoing the heat exchange according to stage c), by then essentially making the flow of fluid leaving the exchange carried out according to the said stage b) circulate around and in contact with thermally conductive walls which delimit externally an internal volume, in which the heat exchange according to stage c) is carried out.

As mentioned at the beginning of the present description, the invention also relates to a device for indirectly heating a flow of gaseous fluid, such as air, this device being characterized according to the invention in that it comprises:

- a first heat exchanger which has an internal volume through which a recycling pipe meanders, in which the combustion products for a heat exchange with the flow of fluid to be heated circulate,
- a second heat exchanger which has an internal volume in fluid communication with the internal volume of the said first exchanger and through which at least one conduit for heat-exchanging fluid runs, for a heat exchange with the flow of gaseous fluid in circulation in this second exchanger,
- and a third heat exchanger which also has an internal volume in fluid communication on the one hand with the volume of the said second exchanger and on the other hand with a conduit for the recovery of the heated gaseous fluid, at least one tube, which is provided for the circulation of combustion products in heat exchange with the said flow of gaseous fluid circulating in the third exchanger, meandering in the internal volume of this latter and being connected to the said recycling pipe for the combustion products.

BRIEF DESCRIPTION OF THE DRAWINGS

The characteristics of the invention which have just been set out, as well as other additional characteristics, emerge in a more detailed manner from the following description which is made with reference to the attached drawings which are given by way of non-limitative examples and in which.

DETAILED DESCRIPTION OF THE INVENTION

Figure 1:
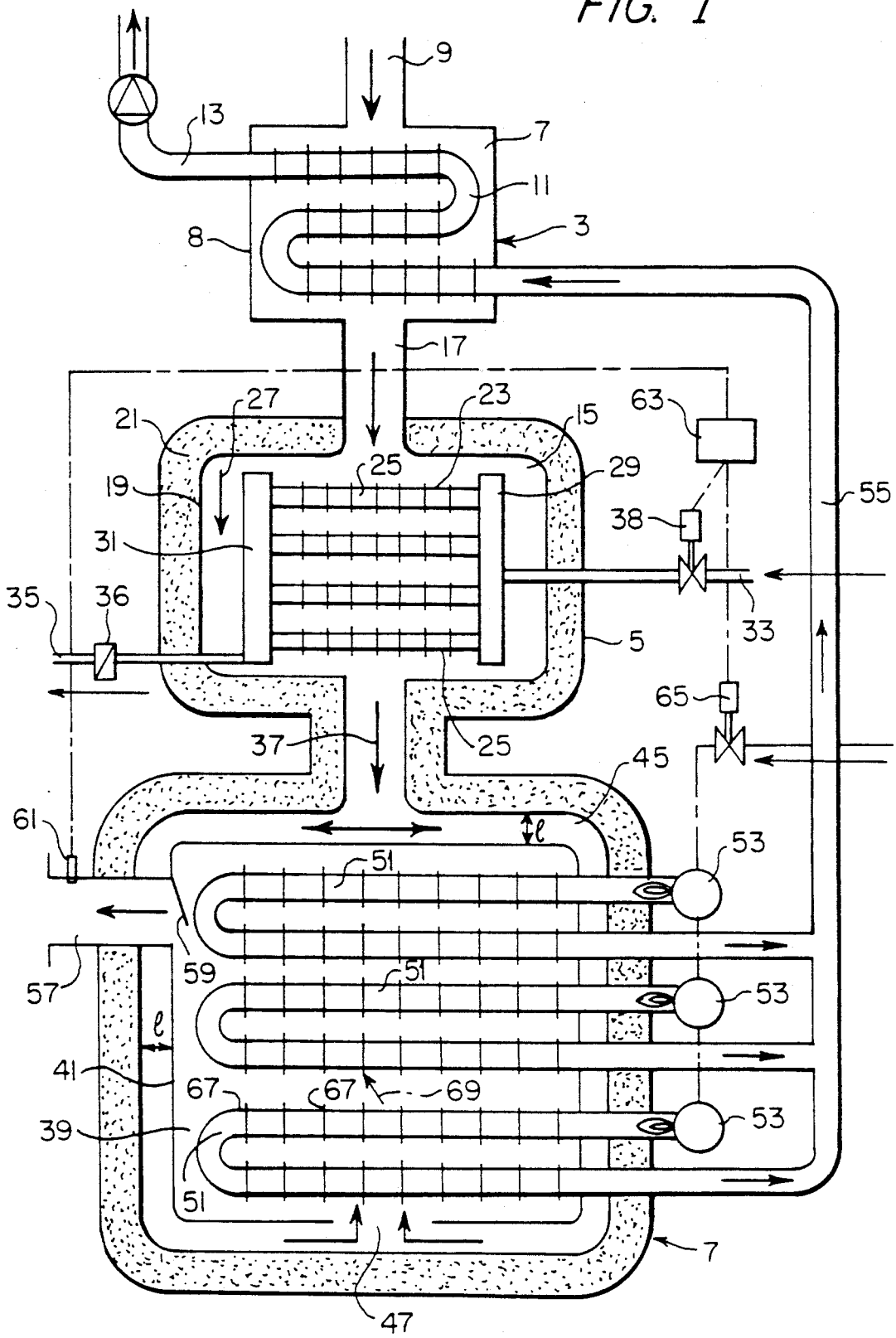
FIG. 1 is a schematic overall view of a possible embodiment of the heating device according to the invention.

With reference in the first instance to FIG. 1, a heating device for gaseous fluid, reference number 1, is illustrated.

The device 1 consists of three successive enclosures which form heat exchangers 3, 5, 7 and are arranged in series, one after another.

As illustrated, the first exchanger 3 consists of an enclosure with walls 6 which can be metal and define a chamber 8 with an internal volume into which, at one end, an intake duct 9 opens for the admission of the flow of fluid to be heated (such as air).

On the interior of the chamber 8, at least one recycling pipe 11 meanders, which can have exchange fins 12 and in which it is envisaged to make circulate the gaseous combustion products for the purpose of an indirect heat exchange with the flow of fluid passing through the chamber 8, and this before these same combustion products are evacuated from the exchanger 3 via the recovery duct 13 to which the pipe 11 is connected.

Essentially opposite the fluid intake duct 9, the internal chamber 8 of the first exchanger 3 is connected, by means of a connecting duct 17, to one end of the internal, chamber 15 of the second exchanger 5, so as to ensure the supply of this exchanger with preheated gaseous fluid.

This exchanger 5 can in particular be made in such a manner that its internal chamber 15 is delimited by metal walls 19 which are externally covered with a thermally insulating casing 21.

On the interior of the chamber 15, a heat exchange battery 23 is arranged, which consists of a number of tubes 25 (possibly with fins) which extend essentially perpendicularly to the direction of circulation of the gaseous fluid in the chamber 15 (direction indicated by the arrow 27). These different tubes 25 are connected at their two opposite ends to two collectors 29, 31. A supply pipe 33 for heat-exchanging fluid is connected to the intake collector 29. In particular, it can be envisaged to use water vapor or synthetic oil vapor as heat-exchanging fluid or thermal fluid. In this case, it is preferable to connect the collector 31 to an evacuation conduit 35 for the vapor condensate, a drain valve 36 advantageously permitting control of the evacuation of this condensate.

In order likewise to achieve control of the throughput of thermal fluid admitted into the exchange battery 23, it has proved to be preferable to arrange a control valve 38 on the in favor of supply pipe 33.

Towards its end which is opposite to the duct 17, the chamber 15 communicates with the internal volume of the third heat exchanger 7, by means of a connection channel 37 which opens on the one hand into the lower part of the chamber 15 and on the other into the upper part of the internal volume of the third exchanger 7.

As is clearly illustrated, also in FIG. 1, the internal volume of this exchanger 7 is divided into a large internal chamber 39 which is delimited externally by thermally conductive (in particular metal) walls 41 which are themselves arranged at a certain distance from a thermally insulated external enclosure 43.

In practice, the connection channel 37 between the exchangers 5 and 7 passes through the enclosure 43 locally and in the upper part to open at one end of the space 45, the width 1 of which is to be sufficient to ensure a correct circulation of the flow of fluid around and in contact with the external conductive walls 41 of the internal chamber 39.

Essentially opposite the connection duct 37, and preferably in the bottom part, the chamber 39 communicates with the space 45 by means of a communication opening 47 in such a manner that the gaseous fluid, which has circulated in this space 45, can penetrate into the interior of the chamber 39 in order to undergo there a further heat exchange with the combustion products circulating within the exchange tubes 51 which are connected, upstream, to burners 53 which can in particular be powered by fuel gas and oxidant air.

In order to limit the problems associated with faulty functioning of a burner, it has been envisaged according to the invention preferably to use a number of exchange tubes 51, each of which is connected, on the exterior but in the immediate vicinity of the enclosure 43, to a burner 53.

As exchange tubes 51, it is preferable to use radiating tubes, for example U-shaped tubes which extend mainly in the internal chamber 39 before being connected in each case, passing through the enclosure 43, to a recovery pipe 55 which is provided to recycle the combustion products leaving the third exchanger 7 in the direction of the pipe 11 of the first exchanger 3.

In FIG. 1, it is also to be observed that, in order to provide for the evacuation and the recovery of the gaseous flow which is heated in the third exchanger 7, the chamber 39 is connected locally and preferably in the top part, to a recovery conduit 57. Advantageously, this conduit 57 is connected to the chamber 39 in a place which is capable of encouraging a circulation of the gaseous flow to be heated there, which is on the whole oriented in a transverse direction in relation to that in which the tubes 51 extend, which are then preferably arranged essentially parallel to one another.

In order to encourage this circulation of the fluid to be heated, the chamber 39 can furthermore be provided, at the connection of the conduit 57, with a deflector 59.

It has also proved to be useful to attach to this assembly a control system which consists of a heat probe 61 which is in direct contact with the recovery conduit 57 and is connected to a control unit 63 which is capable of acting on the one hand on the automatic valve 38 for control of the throughput of thermal fluid through the supply pipe 33 and on the other hand on another automatic valve 65 for control of the supply throughput, for example of fuel gas, to the burners 53.

Since an important characteristic of the invention resides in the design of the third heat exchanger 7, special attention has moreover been given to the production of the latter and in particular to the configuration of the radiating tubes 51.

These latter can of course be made with heat exchange fins, as shown at 67 in FIG. 1, these fins then preferably extending transversely in relation to the general direction (shown at 69) of the flow of gaseous fluid on the interior of the chamber 39.

Figure 2:
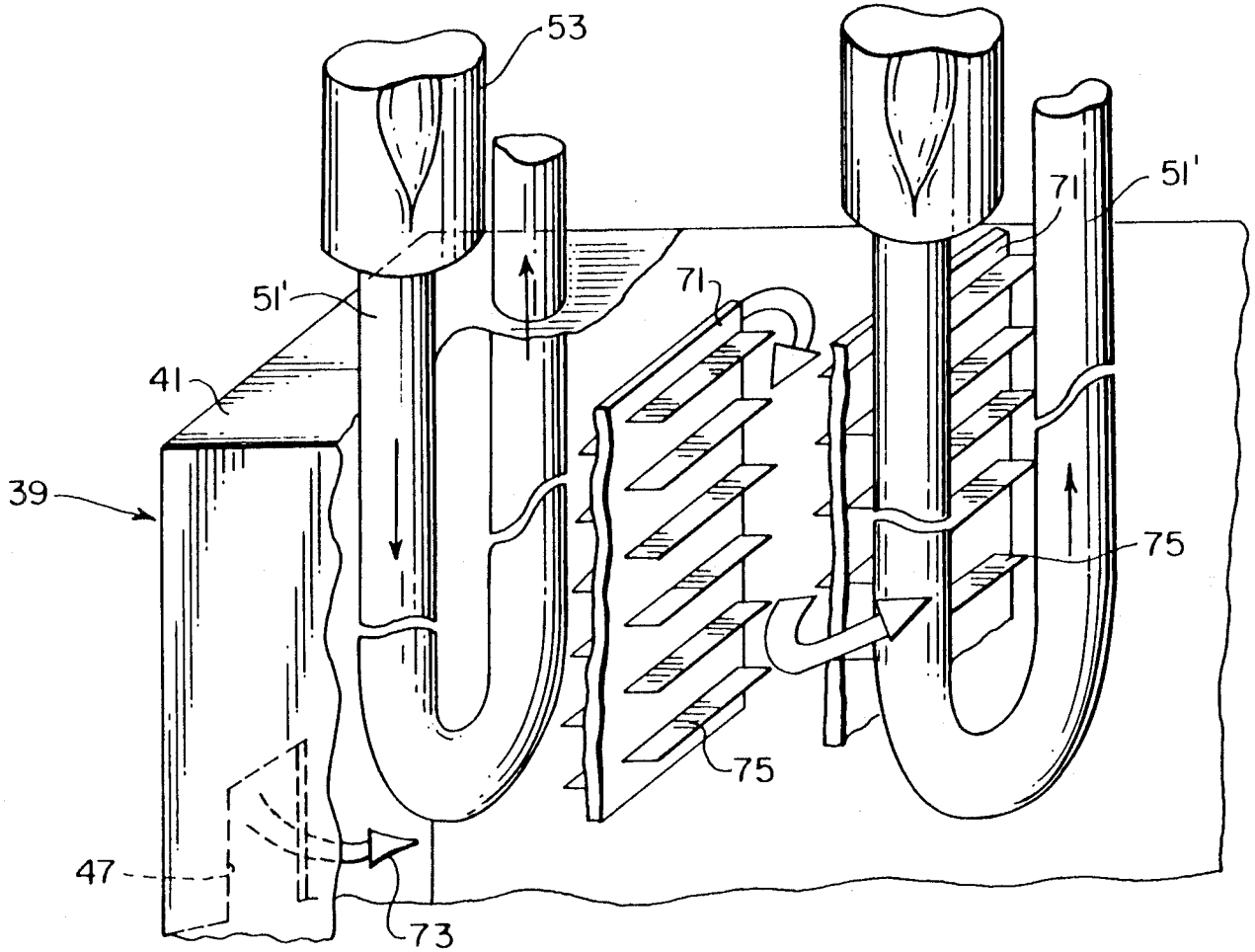
FIG. 2 illustrates schematically an embodiment detail of an internal part of the third exchanger.

However, FIG. 2 shows a cut-away schematic illustration in a perspective view of the chamber 39 in which elbowed radiating tubes 51' are arranged, extending essentially parallel over the entire length of the chamber. These radiating tubes 51', which can have a metal radiating surface, are in the case in point without fins. On the other hand, between two consecutive tubes and at a distance from each of them, convection means are provided, for example in the form of plates 71 with metal convection surfaces, adapted to absorb the energy radiated by the tubes, so as to heat in particular by convection, upon contact with these plates, the fluid (represented schematically by the double arrow 73) which is still admitted into the chamber 39 through the opening 47.

Preferably, the convection plates 71 are provided on their two opposite surfaces with heat exchange fins 75 which advantageously extend transversely in relation to the direction in which a circulation of the fluid is encouraged on the interior of the chamber 39.

It is to be noted that, as illustrated in FIG. 2, the plates 71 are preferably to be arranged so as to constitute, in relation to one another, baffles which lengthen the course of the fluid on the interior of the chamber 39 and encourage its mixing, the fluid thus recovering the calories concentrated around the plates and between the fins 75, which can in particular be metal.

Other types of structurally different convection surfaces of the plates 71 can of course be envisaged, without leaving the scope of the invention.

The principle of functioning of the device, which has been described above, is briefly described below.

This functioning is the following:

The gaseous fluid to be heated, for example air, is first of all introduced into the first exchanger 3 by means of the admission duct 9. This fluid, which can for example be admitted at the ambient temperature of 25° C., is heated in contact with the serpentine formed by the transverse pipe 11 on the interior of which, therefore, the combustion products originating from the burners 53 circulate, after these products have lost a portion of their calories by heat exchange in the third exchanger 7.

While these same combustion products are evacuated via the recovery duct 13, the flow of fluid passes from the chamber 8 of the first exchanger to the chamber 15 of the second exchanger 5 where it is again heated by indirect heat exchange, essentially through the exchange walls of the battery of tubes 25 on the interior of which, therefore, a vaporized thermal, fluid circulates, such as for example water vapor which can be admitted under a pressure of the order of 10 to 15 bar and at a temperature of the order of 230° to 260° C.

In this manner, the gaseous fluid which enters into the second exchanger 5 at a temperature of, for example, 60° to 80° C., can leave it at 180° or even 200° C., indeed possibly more, it being possible to adapt the heating temperature gradient by virtue of the control unit 63 which is preferably to be programmed so that the variations in the rates of heat release are first and foremost absorbed by the vaporized thermal fluid, thus making it possible to reduce to a minimum sudden thermal variations at the burners 53 and the radiating tubes 51 of the third exchanger 7.

Leaving the second exchanger 5, the flow of fluid, already heated by two successive heat exchanges, is then admitted into the peripheral space 45 of the third exchanger 7.

Given the positioning of the access opening 47 to the internal chamber 39 of this third exchanger 7, the fluid to be heated has to first of all, therefore, circulate essentially in contact with the thermally conductive external walls of this chamber 39, thus recovering, in particular by convection, a portion of the calories contained in the chamber 39 and released via the wall 41 of this latter either by the flow of fluid in circulation or by the radiating tubes 51 or 51' and/or by the convection plates 71 and their fins 75 (see FIG. 2).

However, the essential part of the heat exchange carried out on the interior of the third exchanger 7 is carried out on the interior of the chamber 39 when the flow of fluid comes to circulate in the immediate environment of the tubes 51 (or 51'), through which it is possible to transfer, by radiation, the calorific energy contained in the combustion products just leaving the burners 53 (usually at a temperature of approximately 800° to 1,200° C.).

By means of the provision of convection plates 71 (preferably with fins), the energy thus radiated can be absorbed and then restored to the fluid which is thus heated in the chamber 39 by convection, by circulating in contact with the convection surfaces provided to this end, before being evacuated at a temperature which can be estimated as a rule between 350° and 450° C., via the recovery conduit 57 where the heat probe 61 permits the control unit 63 to measure out the supply, on the one hand of vaporized thermal fluid to the second exchanger 5 and on the other hand of fuel to the burners 53, via the valves 38 and 65 respectively, preferably with priority given to the vapor circuit of the exchanger 5.

It is to be noted that with such a heating process, without direct contact between the gaseous fluid to be heated and the heat-exchanging fluids for heating, it is possible to deliver from the device a hot fluid at high temperature, which is free of pollution and can be used, for example, in the agro-alimentary or pharmaceutical industry, in particular for the drying of products or indeed for different thermal processes.

We claim:

1. A heating system for heating a flowing gaseous fluid comprising:

a first heat exchanger which has an internal volume through which a recycling pipe meanders, for circulating combustion products for heat exchange with said flowing fluid to be heated, said first heat exchanger comprising a fluid inlet for admitting said flowing fluid into its internal volume;

a second heat exchanger which has an internal volume in fluid communication with said internal volume of said first heat exchanger and through which at least one conduit passes for circulating a heat exchange fluid in a heat exchange relationship with said flowing fluid to be heated; and, a third heat exchanger which has an internal volume in fluid communication with said internal volume of the second exchanger and with a conduit for recovering the heated gaseous fluid, said third heat exchanger being internally provided with tubes for circulating combustion products in a heat exchange relationship with said flowing fluid, said tubes which are connected to said recycling pipe extending in an internal chamber defined externally by thermally conductive walls, said chamber being arranged on the interior of an outer enclosure defined externally by thermally insulating walls, said outer enclosure being, at one end, in fluid communication with the internal volume of said second exchanger and, at another end, in fluid communication with said internal chamber which is connected to said conduit for recovering the heated gaseous fluid after the latter has circulated in said internal chamber.

2. A heating system for heating a flowing gaseous fluid comprising:

a first heat exchanger which has an internal volume through which a recycling pipe meanders, for circulating combustion products for heat exchange with said flowing fluid to be heated, said first heat exchanger comprising a fluid inlet for admitting said flowing fluid into its internal volume;

a second heat exchanger which has an internal volume in fluid communication with said internal volume of said first heat exchanger and through which at least one conduit passes for circulating a heat exchange fluid in a heat exchange relationship with said flowing fluid to be heated; and a third heat exchanger which has an internal volume in fluid communication with said internal volume of the second exchanger and with a conduit for recovering the heated gaseous fluid, said third heat exchanger being internally provided with tubes for circulating combustion products in a heat exchange relationship with said flowing fluid, said tubes which are connected to said recycling pipe comprising radiating tubes, and convection means are arranged in a spaced-apart relationship to said radiating tubes, said convection means being adapted to absorb the energy radiated by said radiating tubes and to raise the temperature of said gaseous fluid to be heated which is admitted into said third exchanger.

3. A heating system according to claim 2, wherein said convection means consists of metal plates provided with heat exchange fins which extend transversely in relation to the direction in which fluid to be heated is circulated in the interior of said third exchanger.

4. A heating system according to claim 2 wherein the tubes are made of a thermally conductive material and are connected at the exterior of said third exchanger to a burner supplying said tubes with said combustion products.

5. A heating system according to claim 2 wherein said tubes are U-shaped.

6. A heating system according to claim 2, wherein said second exchanger comprises a battery of tubes which are arranged on the interior of a thermally insulated enclosure, and means for supplying a vaporized thermal fluid to said tubes for supplying heat to said gaseous fluid.

* * * * *

UNITED STATES PATENT AND TRADEMARK OFFICE

CERTIFICATE OF CORRECTION

PATENT NO. : 5,061,177

DATED : October 29, 1991

INVENTOR(S) : Gaston Knipiler, et al.

It is certified that error appears in the above-identified patent and that said Letters Patent is hereby corrected as shown below:

On the title page:
In Section 75 (the identification of the inventors), change "GOSSELIN DOMINIQUE" to --DOMINIQUE GOSSELIN--.

Column 1, line 59, change "exchanges" to --exchangers--.

Column 3, line 65, delete "in favor of".

Signed and Sealed this

Sixth Day of April, 1993

*Attest:*

*Attesting Officer*

STEPHEN G. KUNIN

*Acting Commissioner of Patents and Trademarks*